US010916232B1

(12) United States Patent
Hughes et al.

(10) Patent No.: US 10,916,232 B1
(45) Date of Patent: Feb. 9, 2021

(54) ACOUSTICAL OPTICAL PICKUP FOR USE IN STRINGED MUSICAL INSTRUMENTS

(71) Applicant: Taff Optical, LLC, Torrance, CA (US)

(72) Inventors: Kyle Hughes, Redondo Beach, CA (US); David M. Kramer, Rancho Palos Verdes, CA (US); David E. Ball, Rancho Palos Verdes, CA (US)

(73) Assignee: TAFF OPTICAL, LLC, Nashville, TN (US)

( * ) Notice: Subject to any disclaimer, the term of this patent is extended or adjusted under 35 U.S.C. 154(b) by 0 days.

(21) Appl. No.: 16/556,088

(22) Filed: Aug. 29, 2019

(51) Int. Cl.
*G10H 3/18* (2006.01)

(52) U.S. Cl.
CPC ..... *G10H 3/181* (2013.01); *G10H 2210/031* (2013.01)

(58) Field of Classification Search
CPC ..... G10H 3/181; G10H 3/185; G10H 3/06
USPC ..... 187/724
See application file for complete search history.

(56) References Cited

U.S. PATENT DOCUMENTS 5,214,232 A * 5/1993 Iijima ..... G10H 1/0553 84/723
5,237,126 A * 8/1993 Curtis ..... G01V 8/20 84/724
6,859,541 B1 * 2/2005 Hilton ..... G10H 1/0553 381/104
7,507,891 B2 * 3/2009 Lau ..... G10G 7/02 385/10
8,071,870 B1 * 12/2011 Bailey ..... G10H 3/06 84/724
8,249,383 B2 * 8/2012 Catravas ..... G06K 9/6218 382/276
10,083,681 B2 * 9/2018 Haddad ..... G10H 1/0553
2003/0094567 A1 * 5/2003 Ennes ..... G01H 9/00 250/222.1
2005/0051022 A1 * 3/2005 Hodder ..... G01H 9/004 84/724
2007/0295188 A1 * 12/2007 Lu ..... G10D 13/02 84/411 R
2008/0229905 A1 * 9/2008 Lau ..... G10G 7/02 84/454
2010/0154620 A1 * 6/2010 Loock ..... G01H 9/004 84/724
2012/0006184 A1 * 1/2012 Giordano ..... H04R 1/46 84/724
2012/0266740 A1 * 10/2012 Hilbish ..... G10H 3/125 84/645
2014/0165821 A1 * 6/2014 Hughes ..... G10H 3/181 84/724
2016/0035333 A1 * 2/2016 Haddad ..... G10H 3/06 84/724
2017/0263232 A1 * 9/2017 Haddad ..... G10H 1/0553
2017/0278499 A1 * 9/2017 Lee ..... G10H 1/0553
(Continued)

*Primary Examiner* — David S Warren
(74) *Attorney, Agent, or Firm* — Irving Keschner

(57) ABSTRACT

An optical head assembly for use with a stringed musical instrument, the vibrations of the strings causing a light beam to be modulated in accordance with the frequency of the vibrating strings. The modulated light output, produced by the relative motion between two adjacent grates, is coupled to a device with converts the modulated light beam to a corresponding modulated electrical signal which, in turn, is coupled to an amplifier associated with the instrument.

7 Claims, 5 Drawing Sheets

(56) References Cited

U.S. PATENT DOCUMENTS

| | | | | |
|---|---|---|---|---|
| 2019/0198201 | A1* | 6/2019 | Staavi | G05G 1/08 |
| 2020/0193950 | A1* | 6/2020 | Liu | G10C 3/00 |

* cited by examiner

ACOUSTICAL OPTICAL PICKUP FOR USE IN STRINGED MUSICAL INSTRUMENTS

BACKGROUND OF THE INVENTION

1. Field of the Invention

The present invention provides an improved optical electro acoustic transducer for use in any acoustic string instrument, such as guitars, violins, string bass, cello, etc. The transducer uses grates to modulate the tight generated by a tight generating device.

2. Description of the Prior Art

An acoustic guitar, one example of an acoustic string instrument, is a guitar that uses only an acoustic sound board. The guitar has a cavity, air in this cavity resonating with the vibration modes of the string and at low frequencies, the volume of the sound generated increases or decreases depending on whether the air in the cavity is moving in phase or out of phase with the strings. The resonance interactions attenuate or amplify the sound at different frequencies, boosting or damping various harmonic tones.

No amplification actually occurs in this process, in the sense that no energy is externally added to increase the loudness of the sound (as would be the case with an electronic amplifier). AB the energy is provided by the plucking of the string, tire function of the entire acoustic system being to maximize intensity of sound.

An acoustic guitar can be amplified by using various types of pickups or microphones. The most common type of pickups used for acoustic guitar amplification are piezo and magnetic pickups. Piezo pickups are generally mounted under the bride saddle of the acoustic guitar and can be plugged into a mixer or amplifier. Magnetic pickups are generally mounted in the sound hole of the acoustic guitar and are very similar to those found in electric guitars. An acoustic guitar with pickups for electrical amplification is known as an acoustic-electric guitar. Hew types of pickups have been introduced to try to amplify the full sound of these instruments, such as systems that include an internal microphone along with the body sensors or under the saddle pickups.

Most stringed instruments produce their sound through the application of energy to the strings, which sets them into vibratory motion. The strings alone, however, produce only a faint sound because they displace only a small volume of air as they vibrate. Consequently, foe sound of the strings atone requires impedance matching to the surrounding air by transmitting their vibrations to a larger surface area capable of displacing larger volumes of air (and thus producing louder sounds). This calls for an arrangement that allows for foe strings to vibrate freely, but also conducts those vibrations efficiently to the larger surface. A bridge is foe customary means by which this is accomplished (a bridge b a device that supports the strings on a stringed instrument and transmits the vibration of those strings to some other structural component of the instrument in order to transfer the sound to foe surrounding air).

Magnetic sound hole pickups exemplify the same functions as that of electric guitar pickups. Basically, they sense the movement of the strings of plain acoustic or acoustic electric guitars through a magnetic field.

Microphones are accurate transducers used to amplify both plain acoustic and acoustic electric guitars, they convert foe sound produced by foe guitar into electrical signals that are then picked up by amplifiers. In contrast with the magnetic sound hole pickups, microphones are more prone to feedback; as such, it is important that they are placed closely to the guitar, and that performers whose guitars have these transducers should have constrained motions. Despite the drawbacks of microphones, many musicians still prefer using these transducers because of their ability to pick up certain guitar sound characteristics such as high frequency and percussive sounds produced by tapping that cannot be picked up by other transducers.

Contact pickups are hi direct contact with some specific parts of acoustic guitars. They pick up the motions taking place in toe locations where they are installed and convert them into electrical signals that are then picked up by amplifiers. Almost all contact pickups use piezoelectric technology. Notable pickups that fall under this classification include the piezos, top pickups, and under-saddle pickups, toe latter two pickups generally being variations of piezos.

The invention disclosed in U.S. Pat. No. 9,024,712, issued on May 5, 2015, discloses an acoustical transducer which uses a reed member and flexure plate to modulate light in accordance with vibrations of the plucked strings of the instrument. Although this device performs as designed, an improved version of the transducer would be preferred.

What is desired is to provide an acoustical transducer, or pickup, that has a more accurate reproduction to tonal quality of the instrument than provided by current piezo and magnetic pickups and more resistant to feedback than provided by microphones and uses grates to modulate light in accordance with the frequency and intensity of a plucked or bowed instrument string.

SUMMARY OF THE INVENTION

The present invention relates to a transducer device for use with any acoustic string instrument the transducer device providing a more accurate reproduction of tonal quality to the instrument when compared to existing piezo and magnetic pickups and wherein feedback is significantly reduced when compared to microphone transducers.

The acoustic instrument is fitted with a pair of gratings (as used herein the term "grating" means a glass plate having a alternating fines, or patterns, printed on the plate surface) positioned on the instrument bridge or between the bridge and instrument body in such a fashion that the grating can vibrate freely in sync with the instrument. The instrument is also provided with a compact pickup unit attached thereto in an arrangement comprised of cooperating optoelectronic devices including a fight emitting diode (LED) and photodetector with one or both of the optoelectronic devices to measure the relative displacement between the grating mounting locations. The grating positioned between the LED and photodetector interferes with and when stationary, partially obstructs, the path of a light beam generated by the LED toward the light receiving device. The patterns formed on the gratings modulate the frequency and intensity of the light from the LED impinging on the photodetector to produce an electronic signal that corresponds to both the frequency of the note (or notes) played, the intensity of the note and to the tonal quality of the acoustic instrument on which the pickup is mounted. The associated circuitry of the receiving optoelectronic device is biased so that the output signal thereby can be connected to any industry standard instrument amplifier, sound miner board, or audio retorting device.

In essence, the optical pickup of the present invention comprises two primary components; the optical processor and the audio processor. The optical processor has two components; a pickup transmitter housing, a pickup receiver housing which are mounted in longitudinal coaxial alignment when in use. The components of each housing are as follows:

Pickup Transmitter:

1. Visible light, or infrared emitting diode
2. Adjustable castration waveguide
3. Symmetrical leading optical grating window II. Pickup Receiver:

1. Visible light, or infrared, photo-detector
2. Fixed optical waveguide
3. Symmetrical trading optical grating window The audio processor contains the pickup power supply, analog processing, the user operation controls and the external audio interface. The audio signal remains in the analog domain at aft times and is not digitized.

DESCRIPTION OF THE DRAWINGS

For a better understanding of the present invention as well as other objects and further features thereof, reference is made to the following description which is to be read m conjunction with the accompanying drawing therein.

DESCRIPTION OF THE INVENTION

Figure 1:
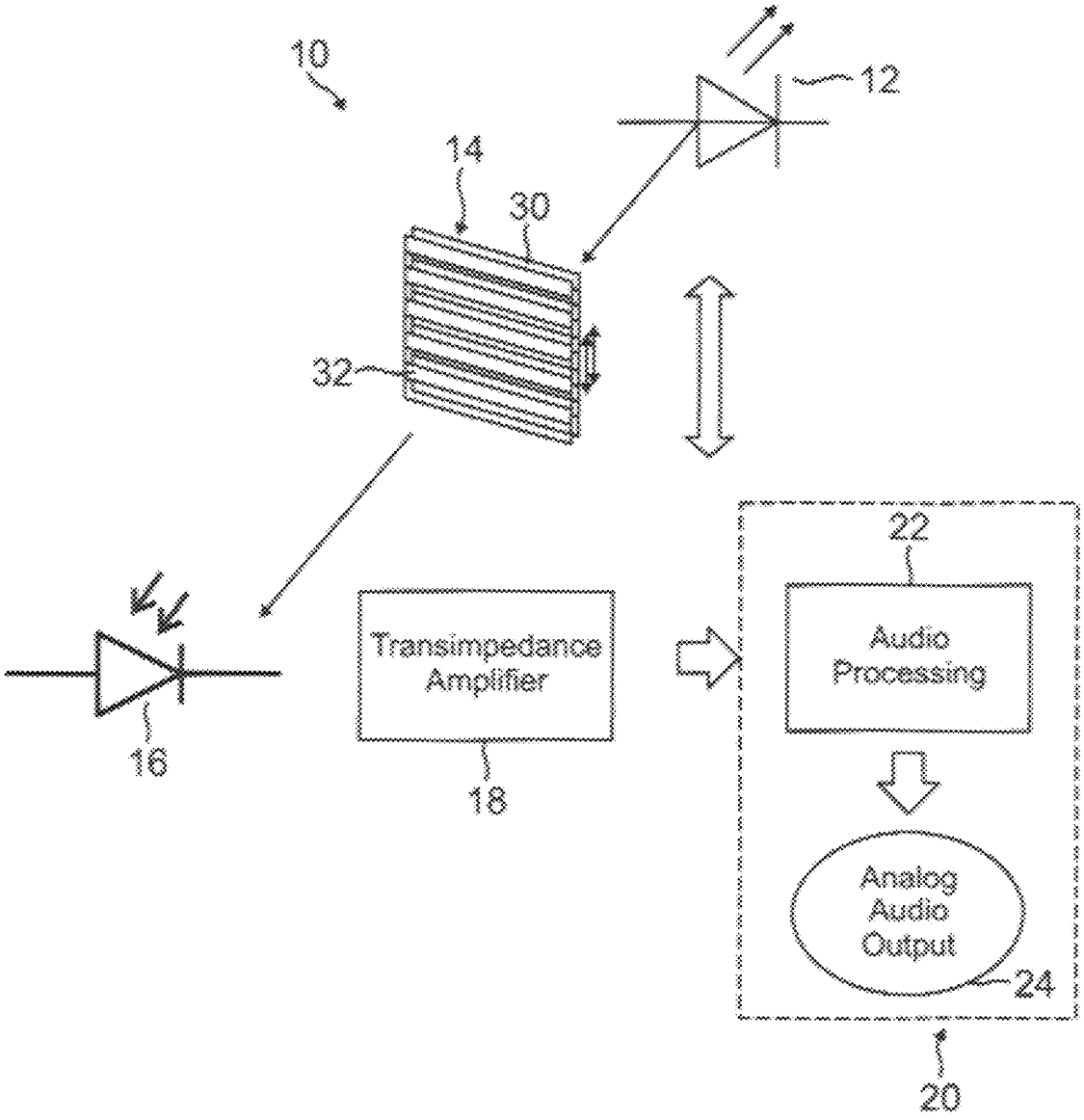
FIG. 1 is a simplified block diagram frustrating the components that comprise the present invention.

Referring to FIG. 1, the component parts of the optical processor portion 10 of the present invention is illustrated. Specifically, optical processor portion 10 comprises LED light source 12, optical grating light shutter assembly 14, opto-detector 16, transimpedance amplifier 18 and audio processor 20 (audio processor 20 comprises the components noted hereinabove and is not considered part of the present invention although for completeness has been disclosed).

Figure 2:
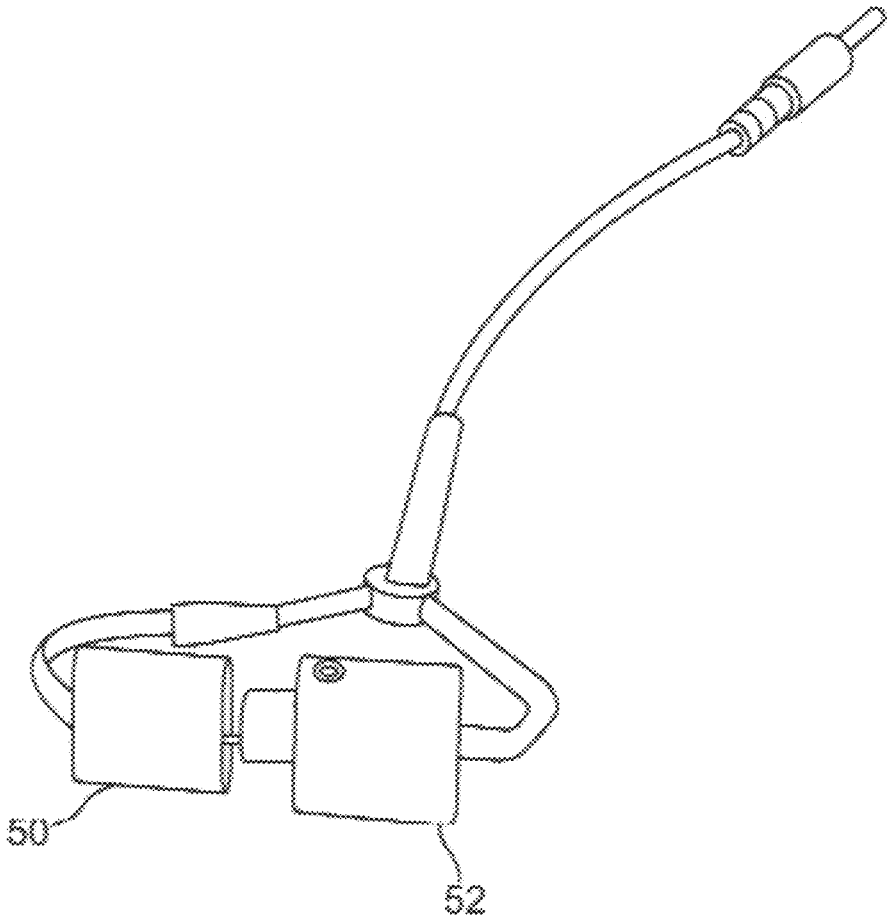
FIG. 2 is a view showing the physical representation of the optical processor of the present invention.

A physical representation of optical processor 10 and components 12, 14 and 16 are shown in FIG. 2 and comprises pickup transmitter 50 which includes an opening for mounting LEO light source 12, adjustable calibration waveguide (entire tube that is pressed into the outer pickup transmitter housing) and a fixed optical waveguide having gratings 30 and 32 positioned therein. The gratings 30 and 32 preferably comprise a transparent (glass) surface having alternate transparent opaque strips (the strips are typically onto the surface formed thereon.

The audio processor 20 contains the pickup power supply, analog audio processing and a user operation controlling external audio interface.

When properly mounted and calibrated, the optical pickup 10 faithfully captures the acoustic energy present at its physical location and accurately produces a corresponding analog audio signal. After power-on, the LED source 12 transmits a controlled, fixed intensity of semi-collimated light through the fixed waveguide in the transmitter housing 50 where the light exits through the primary optical grating 30. Coaxially aligned, the light beam enters first the secondary optical grating 32, the receiver housing 52 through the waveguide within housing 52 and strikes the photo-detector 16.

The relative motion between the pick-up transmitter 50 and receiver 52 in the transverse axis perpendicular to the grating fine pairs 30, 32 produces amplitude modulation of the light beam incident thereon. This is measured as changes in the intensity of the light energy as captured by the photo-detector 16. The pair of primary and secondary gratifies 30, 32 capture relative motion between the two by serving as a continuously variable light shutter, alternatingly passing more or less light in synchronization with the relative motion of the pickup housing.

Performance of the pickup may be optimized for signal to noise and dynamic range by selecting the correct pitch grating with line pairs that are matched to the maximum offset displacement the pickup is to measure. It is desirable to avoid over-modulation by leaving a certain amount over the maximum expected displacement. The pickup will product audible non-linear distortion products when modulation levels exceed either the zero fullyopen or 100% fully closed threshold of the gratings. Due to the optical properties, small size and very low mass of the pickup assembly, the system has no resonant frequency within the audible range. This produces exceptional transient response for the musical instrument. Therefore, the pickup operation approaches an ideal transducer, capturing subtle and fast transient motions with no coloring or introduction of inherent sound artifacts.

The intrinsic properties of the pick-up transducer have a frequency response from DC to well beyond the audible range of 20 KHz. In practice, the very low frequencies may be filtered out in the audio signal processor.

Because of the high sensitivity of the pickup, microscopic changes to the geometry of the musical instrument caused by temperature, humidity or other external factors such as string tuning, may create a relative lateral position offset between the transmitter and receiver. For this reason, each pickup transmitter or receiver preferably contains an adjustment screw to finely align the housing's variable waveguide. Note that this tuning of the pickup does not affect the pitch of the instrument as does standard tuning but instead optimizes the alignment of the components to prevent over-modulation in either direction.

Electrically, the photo detector 16 produces a variable current signal in proportion to the level of light intensity it receives. A transimpedance amplifier stage 18 produces a voltage signal that is then processed solely m the analog domain for maximum signal purity. Low noise, low distortion and high-performance operational amplifiers and high-quality components are used to assure maximum fidelity. To maintain consistency hi operation over time and over the life of the LED battery, the audio processor precisely regulates the LED drive current and aft signal biases.

Figure 3:
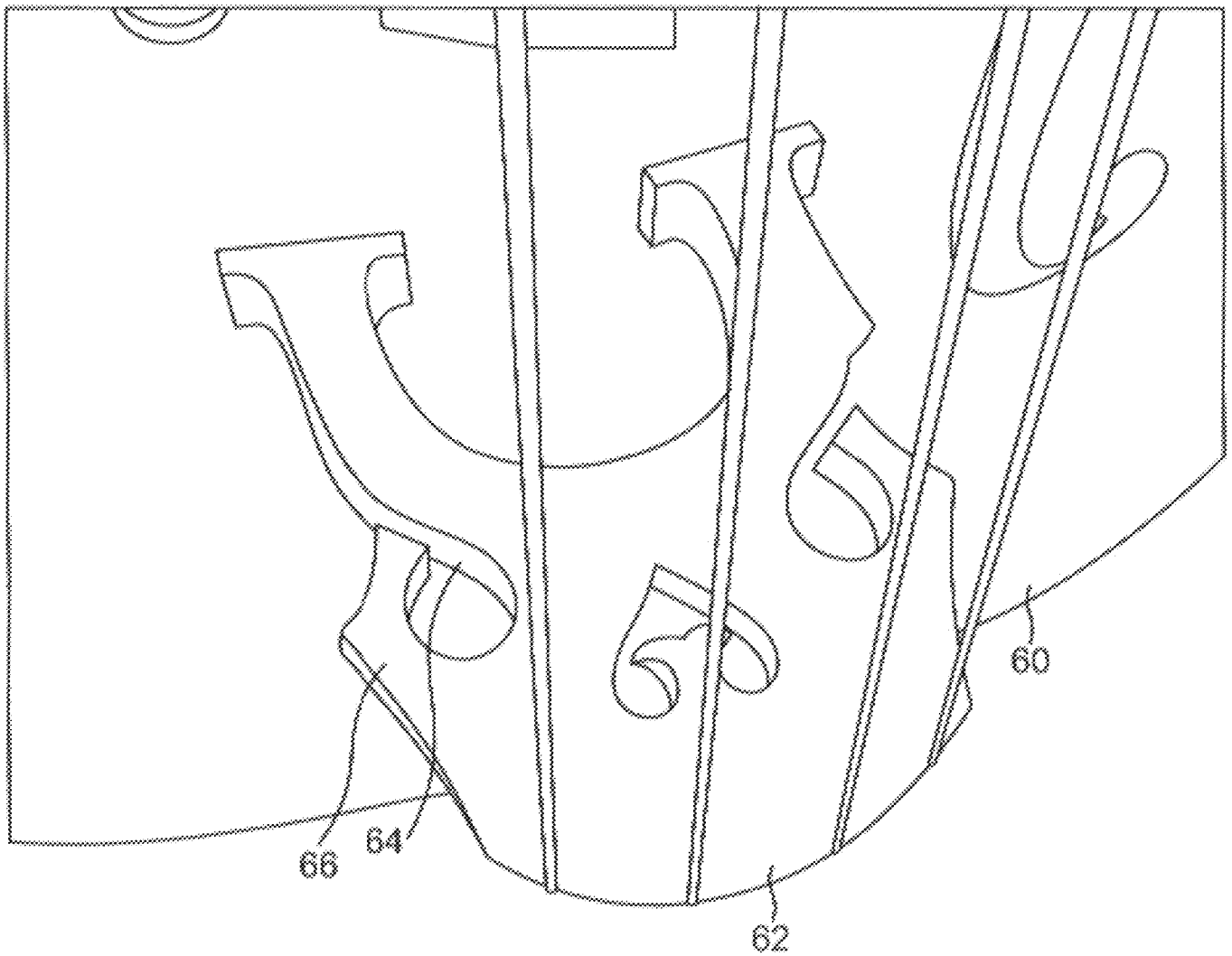
FIG. 3-4 illustrate the pickup transmitter and receivers attached to a stringed instrument.
Figure 4:
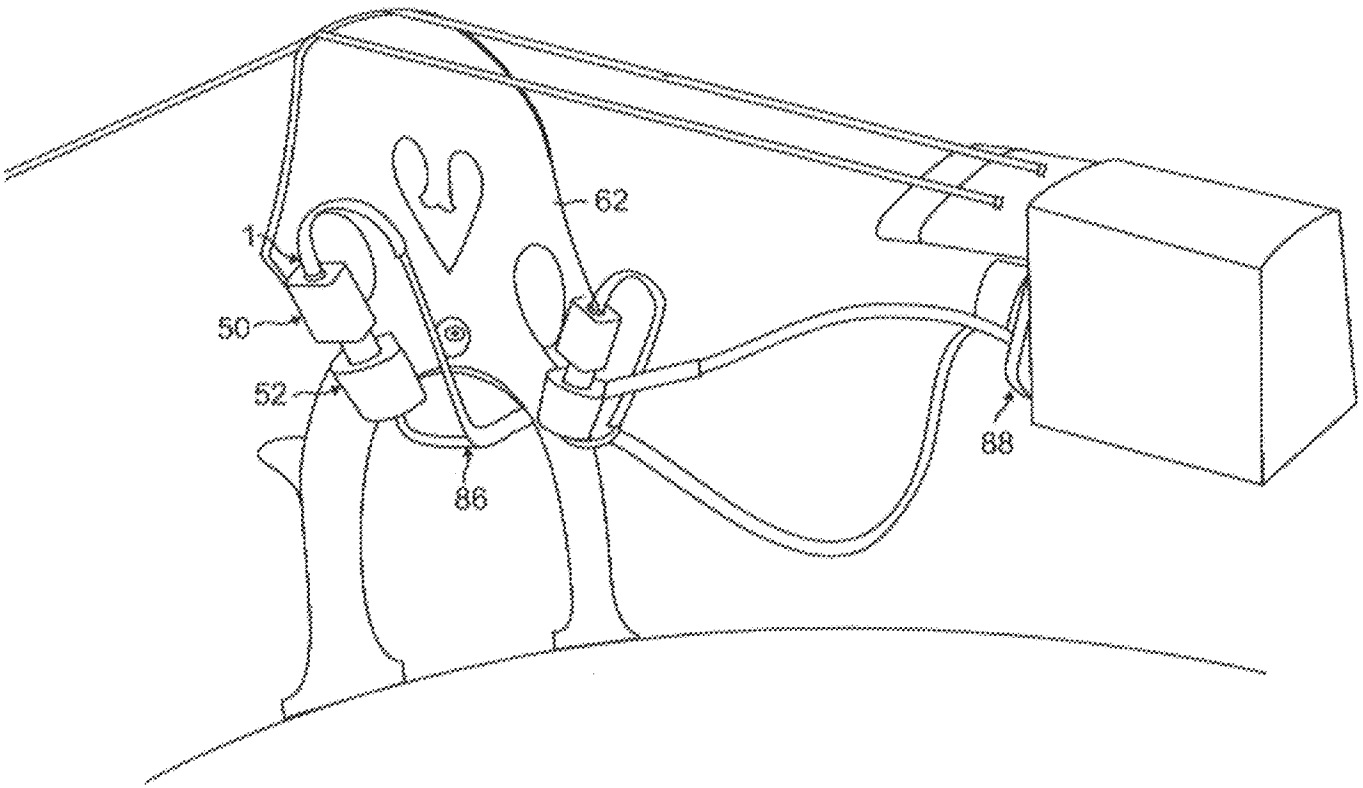

FIG. 3 is a simplified illustration of instrument 60 with bridge 62. As shown, a gap 64 is present between bridge positions 66 and 68. As shown in FIG. 4 transmitter and receiver housing 50 and 52 are mounted on the opposite tide of the bridge 62 adjacent gap 64, in essence, the pull and release of the instrument strings creates movement of the bridge causing the gap size to change and, in turn, causing relative movement between touting a 50 and 52 modulating the incident light produced by LED 12.

Figure 5:
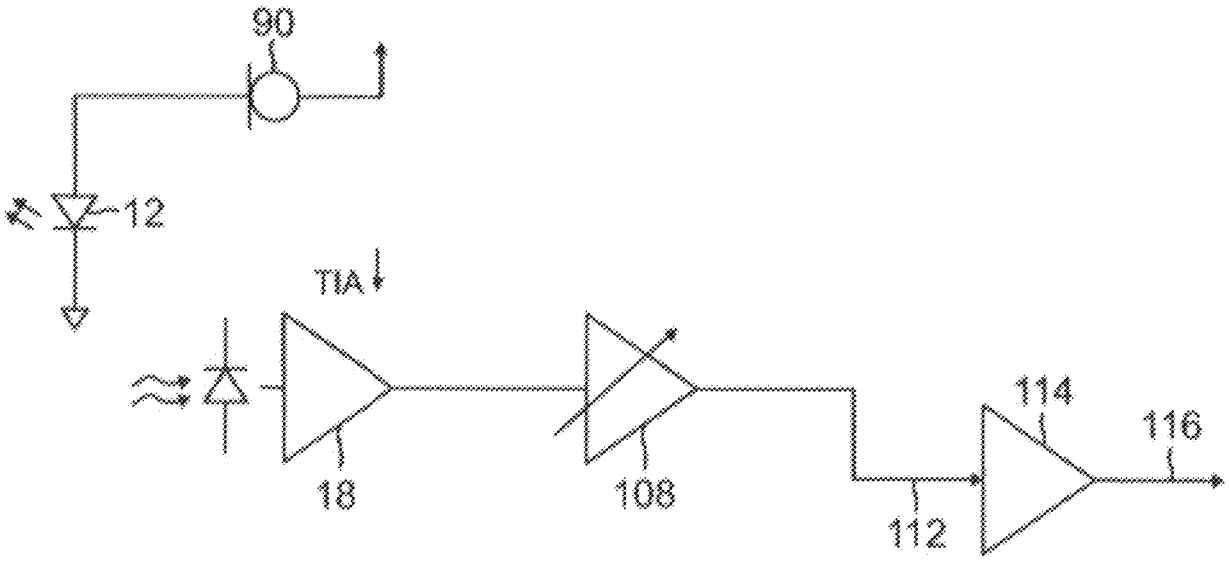
FIG. 5 is a simplified block diagram flow chart of the present invention.

FIG. 5 is a simplified block diagram of the optical pickup of the present invention (although one channel is illustrated, multiple channels can be provided). A constant LED current source 90 powers photodiode 12, the responsive to the modulated light frames generated by grate 14 (FIG. 1)

therefrom being light the output being incident on grate unit 14. The outputs are in turn coupled to adjustable amplifier 108, the outputs of amplifier 108. The output of amplifier 108 is coupled to a mute component 114, the putout of which appears on lead 116. Although not shown, the output on lead 116 is coupled to the amps associated with the stringed instrument itself, the output there of being incident on photodetector 16. The output of the photodetector is incident on transimpedance amplifier 18.

While the invention has been described with reference to its preferred embodiments, it will be understood by those dotted in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A pickup device for a stringed musical instrument having a bridge member with strings positioned thereon comprising:

a first transmissive grate;

a source for generating a light beam, said light beam being incident on said first light transmissive grate;

said grate being positioned relative to said source;

a device spaced from said source and positioned to receive said light beam after passing through said first light transmissive grate, an electrical signal being generated in response thereto; and said source and said device being mounted on opposite sides of said bridge member, said source and said device moving relative to each other when said string are plucked by a user, the light beam transmitted through said grate being modulated as a result of said relative movement; said modulated light beam being converted to a corresponding modulated electrical signal, the amplitude and frequency of said modulated electrical signal varying in accordance with the characteristics of the vibrating instrument strings.

2. The device of claim 1 wherein said modulated electrical signal is coupled to an amplifying device associated with said instrument.

3. The device of claim 1 wherein said source comprises a LED.

4. The device of claim 1 wherein said first tight transmissive grate is operatively coupled to said source.

5. The device of claim 4 wherein a second light transmissive grate is operatively coupled to said device.

6. The device of claim 5 wherein said first and second light transmissive grates each comprise alternate opaque and transparent lines formed on the surface of a plate member.

7. The device of claim 6 wherein said plate member comprises glass.

* * * * *